US005799937A

United States Patent [19]

Nolan

[11] Patent Number: 5,799,937

[45] Date of Patent: Sep. 1, 1998

[54] BASEBALL BAT PRACTICE DEVICE AND METHOD OF MANUFACTURE

[75] Inventor: Timothy J. Nolan, Antioch, Ill.

[73] Assignees: Paul V. Smith, Sr.; Paul V. Smith, Jr., both of Lombard, Ill.; a part interest

[21] Appl. No.: 526,638

[22] Filed: Sep. 11, 1995

Related U.S. Application Data

[63] Continuation-in-part of Ser. No. 296,719, Aug. 26, 1994, Pat. No. 5,501,450.

[51] Int. Cl.[6] ..... A63B 69/00

[52] U.S. Cl. ..... 273/26 B; 273/26 R

[58] Field of Search ..... 273/72 R, 72 A, 273/26 B, 26 R, 67 R, 29 A

[56] References Cited

U.S. PATENT DOCUMENTS

| | | |
|---|---|---|
| 1,696,462 | 12/1928 | Victor . |
| 3,469,839 | 9/1969 | Pietronuto et al. . |
| 4,600,195 | 7/1986 | Hunter . |
| 4,634,121 | 1/1987 | Sasaki . |
| 4,768,785 | 9/1988 | Patterson . |
| 4,869,511 | 9/1989 | Spoonster, Sr. . |
| 4,898,386 | 2/1990 | Anderson . |
| 4,936,586 | 6/1990 | Van Raemdonck . |
| 5,178,394 | 1/1993 | Tanampai . |

*Primary Examiner*—Mark S. Graham
*Attorney, Agent, or Firm*—Meroni & Meroni

[57] ABSTRACT

This invention concerns a baseball batting training device comprised of a weight sized for positioning in co-axial assembly with a knob of a baseball bat. The weight has an internally threaded nut secured in fixed assembly therewith. A threaded bolt bore extends through the weight and is co-axially aligned with the threaded bore defined by the internally threaded nut. A jam nut is threadingly engaged to the bolt. The bolt has external threads and is threadingly engaged through the threaded bore of the internally threaded nut. A pair of annular members are attached to the weight. The annular members are extended away from the weight in a crossed pattern and are positioned in engagement with axially facing remote surface areas of said knob of the baseball bat. The bolt when adjusted exerts a pulling force against the pair of annular members engaged against the axially facing remote surface areas of the knob to hold the baseball batting training device in fixed assembly with the knob of the baseball bat.

16 Claims, 6 Drawing Sheets

BASEBALL BAT PRACTICE DEVICE AND METHOD OF MANUFACTURE

This is a continuation-in-part application of copending application Ser. No. 08/296,719 filed on Aug. 26, 1994, U.S. Pat. No. 5,501,450.

BACKGROUND OF THE INVENTION

1. Field of the Invention

The present invention relates generally to a baseball batting training device. More particularly, the present invention relates to a baseball batting training device that is mounted to a baseball bat and a method of manufacturing the same.

2. Description of the Prior Art

It is well known in the sporting world involving the game of baseball that a lot of practice is required for enabling a baseball player to develop a professional type of a power swing for driving a baseball at the highest possible velocity, even though, in certain instances it may be desired to alter the swing for, so called, bunts, hits to the opposite field and the like. The present invention is concerned with a baseball batting training device suitable for use in practice by a baseball player to aid in developing a more accurate and powerful swing.

In the past, certain types of weights have been used on a bat, such as metal rings, to assist a player in warming up before entry into the batter's box. Other attachments to a baseball bat for training purposes have been used to teach a batter how to make a proper swing when trying to hit a ball. Still other types of baseball batting training devices have embodied a permanently modified baseball bat that audibly signals the batter when he or she is swinging the bat properly. Although these past uses are beneficial, there are still problems with them and they do not address the usage that is the subject of my invention.

The problem with past usage is the limitations inherent in their design. The past usage requires a specially designed baseball bat or permanently altered baseball bat. Thus, a batter can use the past training devices only as training devices and must have other regular bats to use when playing an actual baseball game . Further, where the bat is permanently altered, there is no easy way to return the bat to its original condition. Finally, the past usage only addresses improving a batter's swinging accuracy, rather than, addressing both swinging accuracy and, more importantly, the building up of the hand and arm muscles that a batter uses to swing the bat to produce a powerful swing.

Consequently, the past types of usage and features of a baseball batting training device differ from the one that is the subject of my invention. According to my invention, I have developed a baseball batting training device that is intended to be mounted at a knob end of an ordinary baseball bat and secured by a suitable means in such a way that the weight is located in coaxial alignment with the bat. This device is easily removable and does not permanently alter the baseball bat. The baseball batting training device functions to train the hand and arm muscles that do not get the same work out when using any of the existing baseball batting training devices. Thus ultimately, through training with the baseball batting training device a batter will be able to swing the ordinary baseball bat more accurately and powerfully, thus impacting an oncoming ball harder to make the ball go farther when it is hit.

SUMMARY OF THE INVENTION

According to my present invention I have provided in combination, a baseball bat with a knob at one end, and a baseball batting training device comprised of a weight sized for positioning in co-axial assembly with the knob of the baseball bat, the weight having an internally threaded nut secured in fixed assembly with the weight, a bolt bore extended through the weight co-axially aligned with a threaded bore defined by the internally threaded nut, a bolt with external threads threadingly engaged through a threaded bore of the internally threaded nut, a jam nut threadingly engaged to the bolt, and a pair of annular members attached in integral assembly with the weight, the annular members being extended away from the weight in a crossed pattern and being positioned in engagement with axially facing remote surface areas of a knob of the baseball bat, the bolt exerting a pulling force against the pair of annular members engaged against the axially facing remote surface areas of a knob to hold the baseball batting training device in fixed assembly with the knob of a baseball bat.

Another feature of my invention relates to the baseball batting training device where the bolt has an enlarged head that can be manually turned to cause the external threads to move axially of the threaded bore of the nut for tightening the engagement of a lead end of the bolt against the knob, the bolt being rotatable in a reverse direction to release the tension between the bolt and the knob end of the bat to enable the annular members to be progressively relieved of tension forces for allowing the crossed annular members to be detached from engagement with the knob of the baseball bat. The jam nut has an outer ring portion that can be manually turned to move the jam nut axially along the bolt for secured engagement with a top side of the weight.

In accordance with an alternative embodiment of the present invention a baseball batting training device is provided. The device includes a weight sized for positioning in co-axial assembly with a knob of a baseball bat. The weight has a threaded bore. A bolt has external threads and is threadingly engaged through the threaded bore. A jam nut threadingly engaged to the bolt. Annular members are connected to the weight so that the annular members are extended away from the weight in a crossed pattern and are positioned in engagement with axially facing remote surface areas of said knob of the baseball bat. The bolt exerts a pulling force against the pair of annular members engaged against the axially facing remote surface areas of the knob to hold the baseball batting training device in fixed assembly with the knob of the baseball bat.

A method of manufacturing one embodiment of the present invention, comprises the steps of. forming a mold having a cup shaped mold cavity, the mold having a threaded bore at a bottom side of the mold in communication with the mold cavity; threading the bolt through the mold in threaded engagement with the threaded bore; threading an internally threaded nut on the bolt so that the nut is within the cup shaped mold cavity in a spaced apart relationship with a mold cavity bottom of the cup shaped mold cavity; forming a pair of annular members by clamping opposite ends of a pair of wires with clamps; inserting the clamps of the annular members into the cup shaped mold cavity so that a clamp of each annular member is on either side of the bolt; and pouring a molten lead in the cup shaped mold cavity to envelope the clamps and an outside surface of the nut to create a molded product.

A method of manufacturing an alternative embodiment of the present invention, comprises the steps of: forming a circular weight; drilling and tapping a threaded bore through the weight; drilling a first aperture extending through the weight perpendicular to the threaded bore on one side of the weight; drilling a second aperture extending through the weight parallel to the first aperture on another side of the weight; threading a jam nut onto a bolt; threading the bolt through the threaded bore of the weight; and attaching a pair of annular members to the weight so that the annular members are attached on either sides of the bolt.

BRIEF DESCRIPTION OF THE DRAWINGS

FIG. 12 is a top plan view of the blank in FIG. 11 only having a threaded screw hole drilled there through;

FIG. 20 is a side view of a circular blank of steel for use in the manufacture of a third embodiment of my baseball batting training device, with a screw hole for engaging a set screw drilled there through;

DETAILED DESCRIPTION OF THE PREFERRED EMBODIMENT

Figure 1:
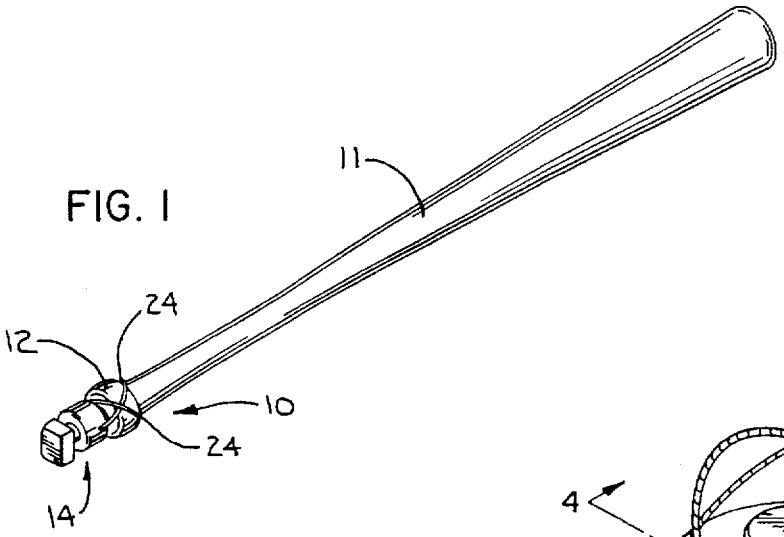
FIG. 1 is a perspective view of my new combination including a baseball bat and the first embodiment of my baseball batting training device mounted on a knob and thereof.

My invention contemplates a new and improved combination 10, which includes a baseball bat 11 having a knob 12 at one end and a baseball batting training device or baseball bat practice device 14, as shown in FIG. 1. It is contemplated that this training device 14 can be easily attached and removed from a knob end of the bat 11 by the user. It is further contemplated that the baseball training device 14 also has inventive features apart from the combination as a training device which can be marketed through sporting outlets for purchase by the public at large.

Referring now to FIGS. 2–9, the training device 14 contains a weight 15 that is sized for positioning in coaxial assembly with the knob 12 of the baseball bat 11. Preferably, the weight is formed of metal, however, it is to be understood that plastic Teflon, porcelain or any other type of suitable material may be used. It is contemplated that the training device weight can range in size from one to thirty-two ounces, as desired. Excellent results can be obtained where the training device has a weight of approximately fourteen ounces for adult use and eight ounces for children's use. In this embodiment, the weight 15 itself is preferably comprised of lead with certain components having been cast and formed integral with the weight 15 . To this end, the weight 15 is so formed as to be provided with and internally threaded with a steel nut 16. This nut is comprised preferably with a hard metal which is harder than lead so as to provide threads 20 which have an extended life. The weight 15 has a bolt bore 18 which extends coaxial out of a threaded bore 19 provided in the threaded nut 16. The threads 20 are provided internally of the bore 19 for coaction with a bolt 21. The bolt 21 has external threads 22 that are threadingly engageable with the threads 20 in the threaded nut 16.

Figure 2:
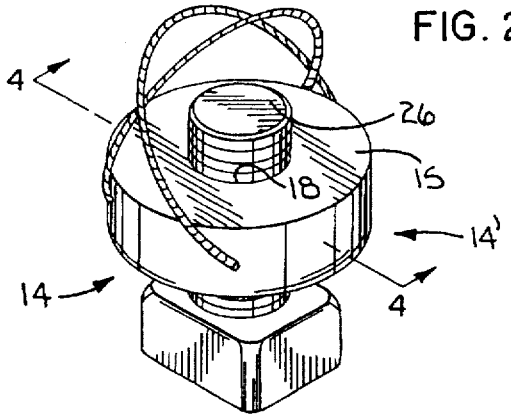
FIG. 2 is an enlarged perspective view of the first embodiment of my baseball batting training device shown in FIG. 1.
Figure 3:
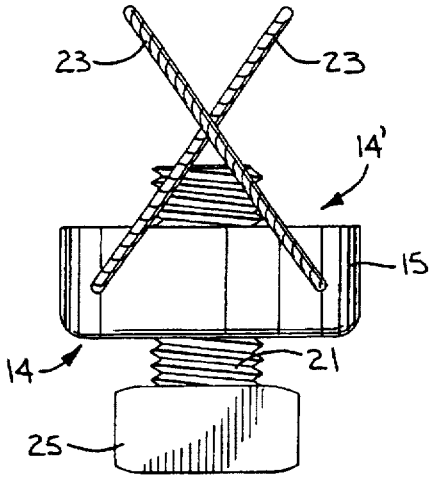
FIG. 3 is an enlarged side view of the baseball batting training device shown in FIG. 1.
Figure 4:
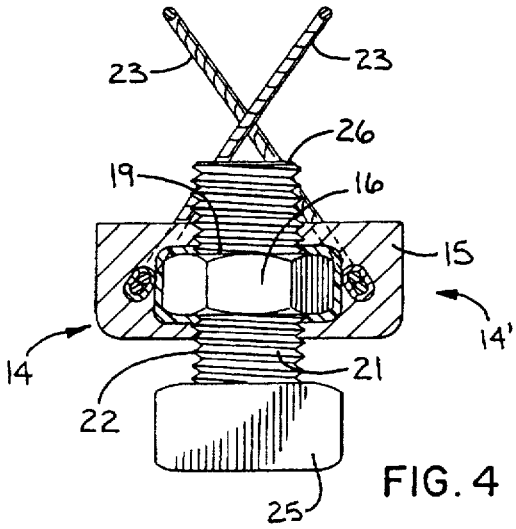
FIG. 4 is an enlarged cross section of my baseball batting training device taken on the line 4—4 looking in the direction indicated by the arrows as seen in FIG. 2.
Figure 5:
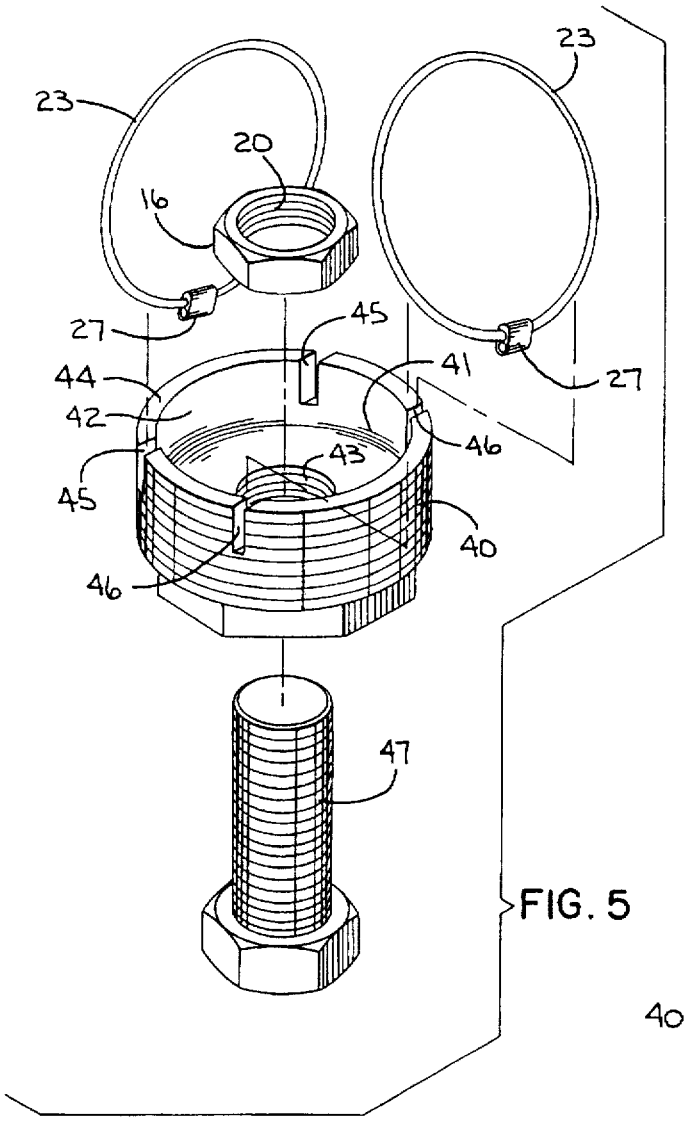
FIG. 5 is an exploded view of a die for forming the first embodiment of a baseball batting training device shown with several components of the baseball batting training device.
Figure 6:
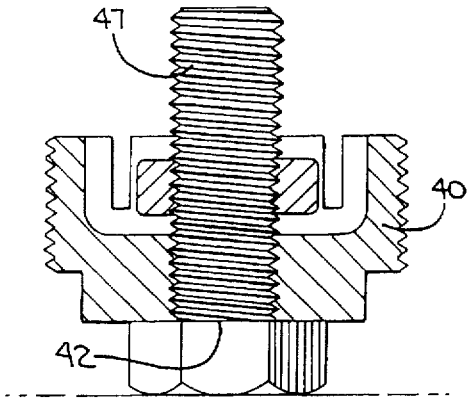
FIG. 6 is a cross section view of the selected components of the die shown in assembled relation and with a die bolt shown in elevation.
Figure 7:
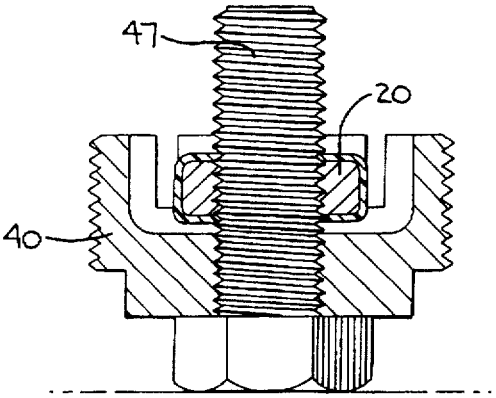
FIG. 7 is a enlarged partially cross sectioned view similar to FIG. 6.
Figure 8:
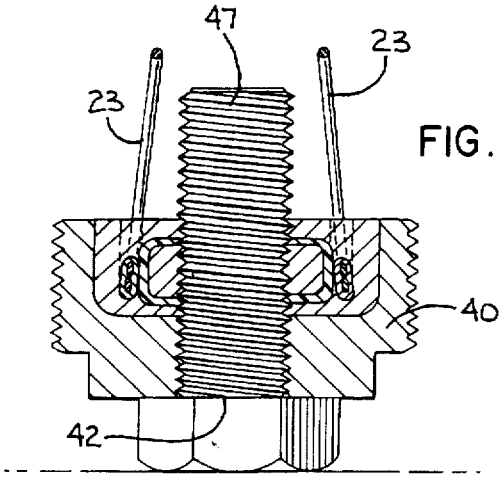
FIG. 8 is an enlarged partially cross sectioned view similar to FIGS. 6 and 7 only with the annular members being shown embedded in the material poured into the die.
Figure 9:
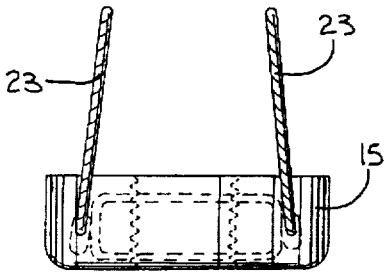
FIG. 9 is an enlarged side view of a cast part of my baseball batting training device prior to the assembly of the threaded bolt therewith as seen in FIG. 2.
Figure 10:
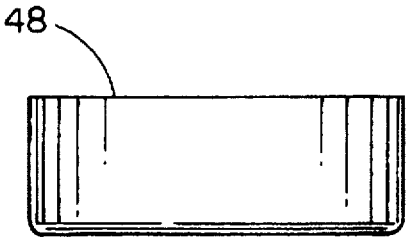
FIG. 10 is a side view of a circular blank steel for use in the manufacture of a second embodiment of my baseball batting training device.
Figure 11:
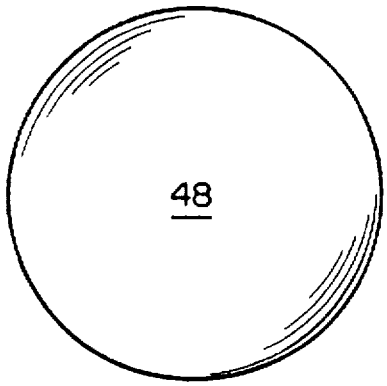
FIG. 11 is a top plan view of the blank in FIG. 10.
Figure 12:
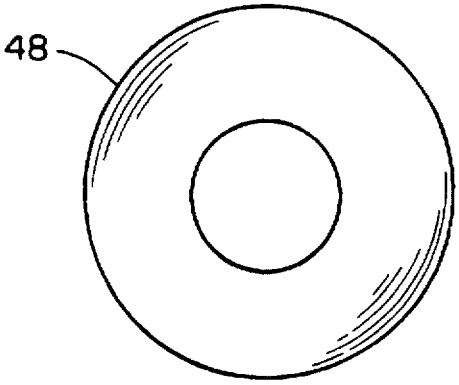
Figure 13:
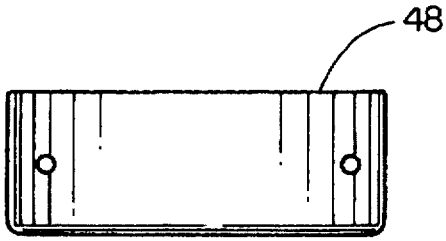
FIG. 13 is a side view of the blank in FIG. 12 with wire holes provided in an exterior circumferential surface.
Figure 14:
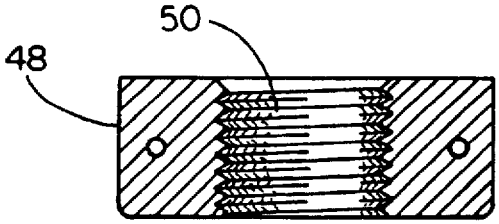
FIG. 14 is a cross section view through out the blank in FIG. 12 with the hole having screw threads.
Figure 15:
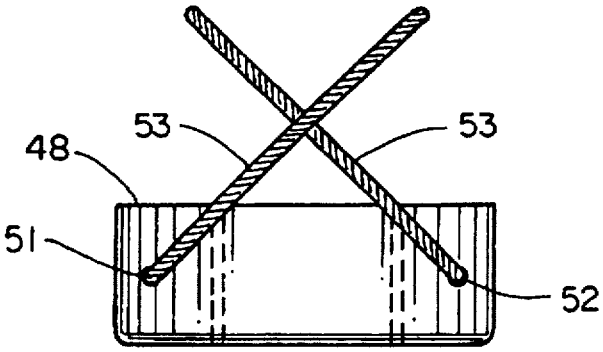
FIG. 15 is a side view of the blank in FIG. 14 only with attachment wires mounted on the weight and secured in the circumferential spaced holes by means of spot welds.
Figure 17:
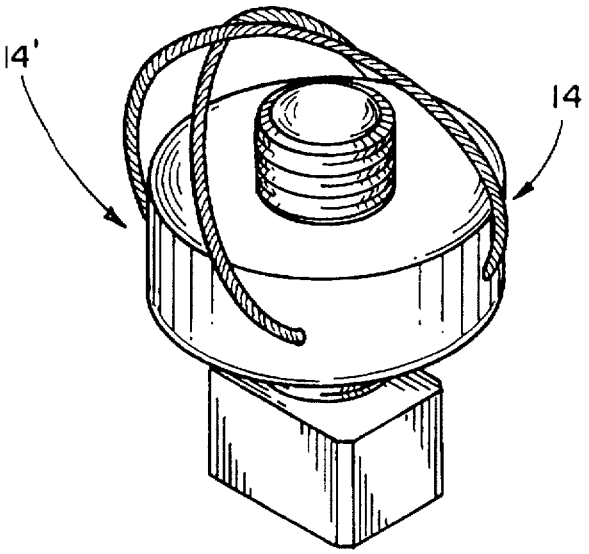
FIG. 17 is a perspective view of the second embodiment of my baseball batting training device shown in FIG. 16.
Figure 16:
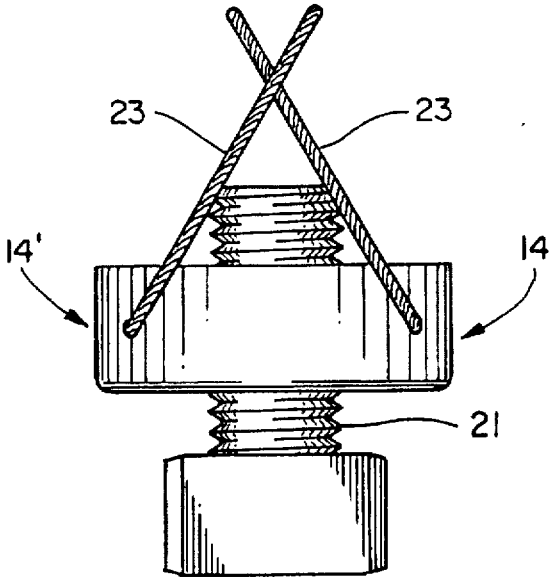
FIG. 16 is a side view of the second embodiment of my baseball batting training device with a threaded bolt secured in assembly made in accordance with the teaching shown in FIGS. 10–15 inclusive.
Figure 18:
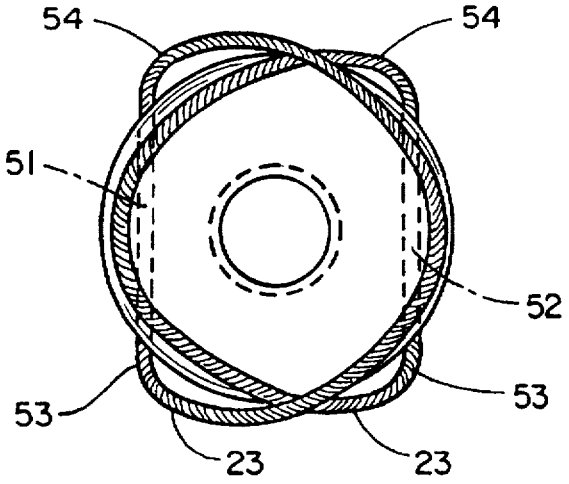
FIG. 18 is a top plan view of the device shown in FIG. 17.
Figure 19:
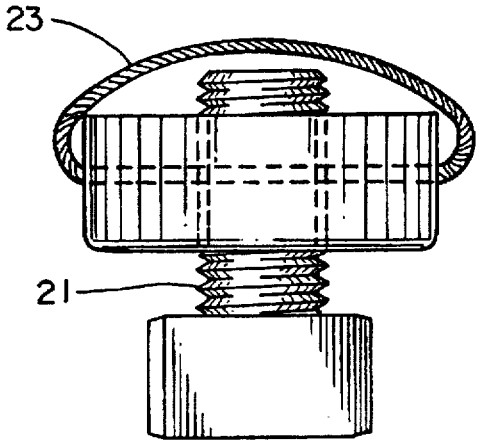
FIG. 19 is another side view of the second embodiment of my baseball batting training device similar to FIG. 16, only as viewed at right angles to the device shown in FIG. 16.
Figure 20:
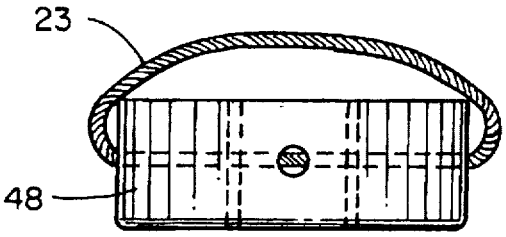

Also provided upon the training device 14 are a pair of annular ring shaped members 23,23 which are formed in integral assembly with the weight 15 as will be hereafter described in further details. The annular members 23,23 are extended away from the weight in a crossed pattern as shown in FIG. 2 and are positioned in engagement with axially facing remote surface areas 24,24 on the knob 12 of the bat 11.

Figure 24:
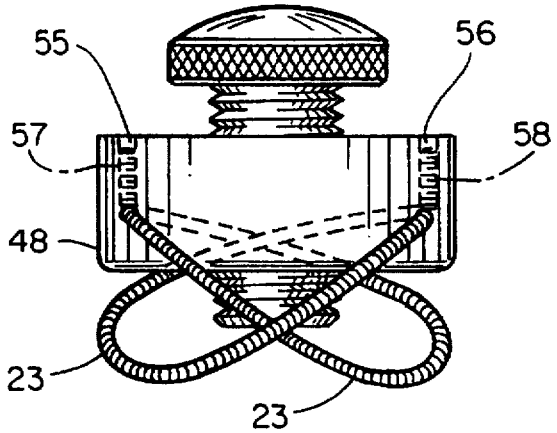
FIG. 24 is a side view of the fourth embodiment of my baseball batting training device having a pair of set screw holes drilled there through on a top side of the weight.

The bolt 21 has an enlarged head 25 which can be manually turned to cause the external threads 22 to move axially of the threaded bore 19 of the nut 16 for tightening engagement of a lead end 26 of the bolt 21 against the knob 12. The bolt is rotatable in a reverse direction to release the tension between the bolt 21 and the knob end 12 of the bat 11 to enable the annular members 23.23 to be progressively relieved of tension forces for allowing annular members 23.23 to be detached from engagement with the knob 12 of the bat 11. Preferably, the enlarged head 25 of bolt 21 is rounded, as shown in FIG. 24.

The annular members 23.23 are preferably comprised of woven steel rings. Opposite ends of each of the rings are secured together by means of a clamp 27 so that the rings cannot be readily pulled out of the weight 15 when formed in embedded assembly during the manufacture process for forming the weight.

In order to secure the baseball batting training device 14 to the baseball bat , the annular members 23.23 are moved into proximity to an opposing annular rim of the knob 12 and the bolt 21 is turned at its enlarged head 25 to cause the external threads 22 to move axially toward the bat in the threaded bore 19 until the lead end 26 of the bolt 21 engages the knob end of the bat whereupon the annular members 23.23 are progressively drawn taut as the threaded bolt 21 is further tighten by turning of the head end. Once the annular members 23.23 are drawn taut against the knob then further adjustment can be discontinued as the baseball training device 14 should then be firmly secured to the baseball 11. As stated before, by using clamps to secure the ends of the annular members 23.23, resistance forces can be set up to prevent the annular members from being disengaged from the weight 15. By providing a nut 16 which is embedded in the weight 15 where the nut is made of steel thus providing threads of greater strength, the life of the baseball training device 14 can be extended. It was found that where threads were formed in the lead weight that the life of the baseball training device was materially reduced. Referring now to an alternative embodiment illustrated in FIGS. 10–19, a circular blank steel or weight 48 is circular in shape and formed from a single piece of metal. The weight 48 has a threaded bore 50. A bolt 21, similar to the one previously described, has external threads and is threadingly engaged through the threaded bore 50. Annular members 23.23 are connected to the weight 15 so that the annular members are extended away from the weight in a crossed pattern and are positioned in engagement with axially facing remote surface areas of said knob of the baseball bat. As previously described, the bolt 21 exerts a pulling force against the pair of annular members engaged against the axially facing remote surface areas of the knob to hold the baseball batting training device in fixed assembly with the knob of the baseball bat.

The weight 48 has a pair of wire holes referred to as first aperture 51 and second aperture 52. The first aperture 51 extends through the weight perpendicular to the threaded bore 50 on one side of the weight. The second aperture 52 extends through the weight 48 parallel to the first aperture 51 on another side of the weight. The annular members 23.23 have a first end 53 and a second end 54. The first end 53 of one annular member is inserted into one end of the first aperture 51 and the second end 54 of that annular member is inserted into the other end of the first aperture 51. The first end 53 of the other annular member is inserted into one end of the second aperture 52 and the second end 54 of that annular member is inserted into the other end of the second aperture 52. These points of insertion are then spot welded to secure the annular members 23.23 to the weight. However, it is to be understood that other forms of securement such as adhesive and liquid metal could equally be used.

Figure 21:
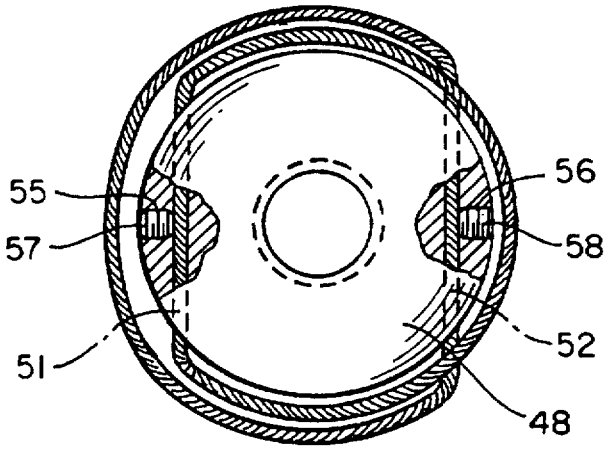
FIG. 21 is a top plan view of the device shown in FIG. 20, having a threaded screw hole drilled there through and a pair of set screw holes drilled there through on two sides of the circular blank of steel.
Figure 22:
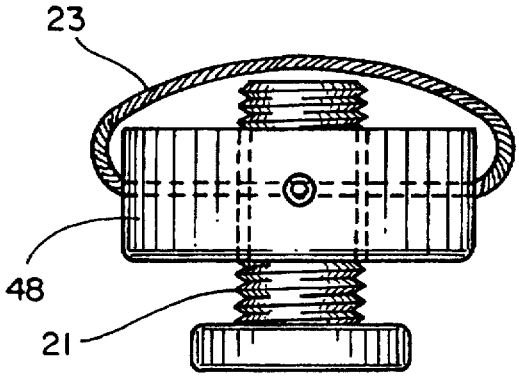
FIG. 22 is a side view of the third embodiment of my baseball batting training device similar to that shown in FIG. 20, now with a threaded bolt secured in assembly made in accordance with the teaching shown in FIGS. 21 and 22 inclusive.
Figure 23:
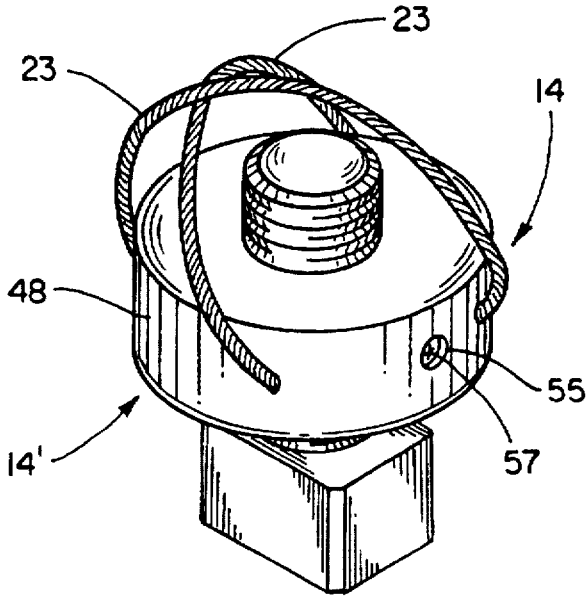
FIG. 23 is a perspective view of the device shown in FIG. 22.

Referring now to FIGS. 20–23, yet another alternative embodiment is shown. A weight 48 is provided which is similar to that shown in FIGS. 10–14. The weight has a first aperture 51 and a second aperture 52. However, the first aperture 51 and second aperture 52 have a diameter greater than that shown before to accommodate the thickness of two wires so that the first end and second end of one annular member can be inserted into the first aperture in lapped relationship, as best shown in FIG. 21. The first end and second end of the other annular member is inserted into the second aperture 52 in a similar lapped relationship.

The weight has a first threaded screw bore 55 perpendicular to and in communication with the first aperture 51 and a second threaded screw bore 56 perpendicular to and in communication with the second aperture 52. A first set screw 57 is inserted or screwed in threaded engagement within the first threaded screw bore 55 and in pressing engagement with the first end and the second end of one annular member so that the annular member is tightly secured to the weight. A second set screw 58 is inserted or screwed in threaded engagement within the second threaded screw bore 56 and in pressing engagement with the first end and the second ends of the other annular member.

Figure 25:
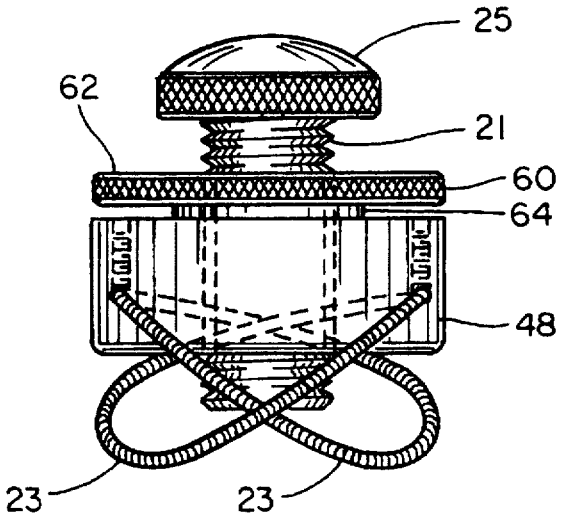
FIG. 25 is a side view of my baseball batting training device having a jam nut for securing the bolt.
Figure 26:
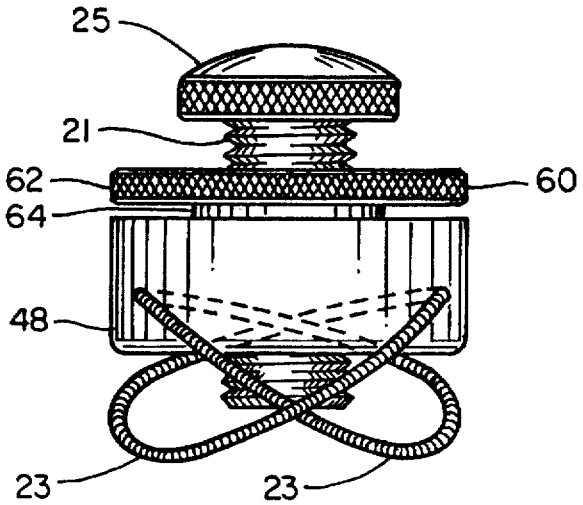
FIG. 26 is a side view of my baseball batting training device having a jam nut for securing the bolt.
Figure 27:
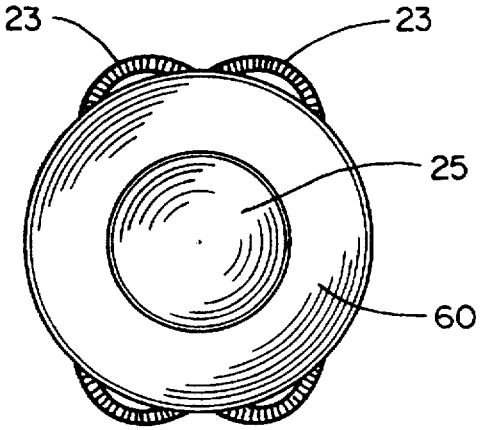
FIG. 27 is a top view of the fourth embodiment of my baseball batting training device.

Referring now to FIGS. 24–27, a preferred alternative embodiment is shown. This embodiment is generally similar to that previously described and shown in FIGS. 20–23, except for the following noted differences. As best illustrated in FIGS. 25–26, a jam nut 60 formed of metal is provided. The jam nut 60 has internal threads for threaded engagement on the bolt 21. The jam nut 60 has an outer ring portion 62 that can be manually turned to move the jam nut 60 axially along the bolt 21 for secured engagement with a top side of the weight 48. In use, as the outer ring portion 62 of the jam nut 60 is turned, a lower ring portion 64 of the jam nut 60 is caused to bite into and grip the weight 48. Preferably, the outer ring portion 62 and lower ring portion 64 are formed integral therewith to create the jam nut 60. The outer ring portion 62 may have a diameter equal to or greater than the diameter of the weight 48. For example, the outer ring portion 62 having a diameter approximately ⅛ to ¼ of an inch greater than the diameter is shown in FIG. 26 and allows for increased accessibility of the jam nut 60. It is to be understood that other jam nut designs commonly known to one skilled in the art could equally be used. Preferably, outer circular sides of the enlarged head 25 of the bolt 21 and of the outer ring portion 62 of the jam nut 60 are knurled or textured to make manual turning easier.

Preferably, the first threaded screw bore 55 and second threaded screw bore 56 are parallel to the bolt 21 and have respective openings for the first set screw 57 and second set screw 58 on the top side of the weight, as shown in FIGS. 24–25. With this configuration, the drilling and tapping of the bores for the set screws and the bolt may all be machined without having to move the weight from one weight holder fixture to another.

Another part of my invention involves my method of manufacture of the baseball bat training device for attachment to the knob end of a baseball bat. In this connection I have developed a die or mold 40 for manufacture of my baseball training device 14, as shown in FIGS. 5–9. The main part of the mold is a cup shaped member having a cup shaped mold cavity 41 with a central opening 42 which is threaded at 43. An upper rim 44 of the cup-shaped member has two pairs of slots 45, 45 and 46, 46 which are on opposite sides of the rim 44 and which confront one another. These slots are machined to provide resting places for the annular members 23, 23, which comprise wires that are to be placed in the mold 40 during the molding operation for securement with the lead weight 15 that forms a part of the baseball batting training device 14.

It is significant that the annular members or wires 23, 23 that have their ends clamped together have a length of seven (7) inches in one preferred embodiment. By providing the annular members or rings 23, 23 having an initial length of seven inches, and by embedding parts of the wire rings 23, 23 in the mold 40, there is enough wire to encompass the knob 12 of the bat and then the threaded bolt can be threaded into the center section of the weight with a lead end of the bolt then engaged against the knob end of the bat to spread the wires taught to secure the assembly in engagement with the bat.

Returning to the description of the molding procedure for the manufacture of my baseball batting training device 14, it will be observed that a longer threaded die bolt 47 than the one that is actually used on the weighted practice device is used for the molding of the lead weight 15. The reason a longer bolt is used involves a need for a longer shank so that when the molding process is about to commence and everything is in readiness for receipt of the molten lead, the upper end of the threaded bolt 47 will project high enough so that it will not interfere with the pouring procedure of the molten lead into the cavity of the mold 40.

A close fit is needed between the shank of this bolt 47 and the opening 42 in the bottom of the cup shaped mold. However, no threads are necessary and that molding procedure can be completed without the threads.

It will also be appreciated that the mold described is designed to provide a way for manufacture of the prototype of this embodiment, but that in final manufacturing procedures, the mold will be refined. To this end, the slots will be better aligned at the open end of the socket and not offset as they are now shown.

In the molding operation, it will be appreciated that the steel threaded nut 16 that is to be embedded within the molded lead is threaded down on the shank on the threaded bolt to such a point that it is in spaced relationship with respect to the bottom of the mold cavity so that when the lead is poured, the steel nut will be exteriorly encased by the lead except at the area where the bolt is threaded through the center of the nut. Once the lead is poured into the mold, it will also envelope segments of the wire rings so that these wire rings will also be permanently adhered within the lead casting. It is in this way that the two rings and the steel nut are embedded within the lead to complete the formation of the components forming this device.

Once the molten lead has cooled, the lead becomes hard and the molded product can be knocked from the mold after the threaded bolt is unthreaded from the nut by using another tool and a hammer to disengage the molded lead casting from the mold.

At this point in time, the molded product must then be cleaned and a file can be used to smooth the edges of the lead where required. Then the product can be painted with a plastic paint of suitable type. The die bolt is then removed from the molded product if it has not been removed already. A jam nut 60 is threaded onto a bolt 21 and the bolt is threaded into the molded product. Additionally, the outer circular sides of the enlarged head 25 of the bolt 21 and of the outer ring portion 62 of the jam nut 60 may be knurled or textured by conventional methods to make manual turning easier It should also be noted that preferably the size of the diameter of the shank of the bolt is ¾" instead of ⅝", for example. This provides a greater tip end area for engagement of the bolt against the knob end of the bat to resist wobble and movement of the weight when it is attached to the bat. The length of the ¾" bolt would be 1 ½".

In summary, the method of manufacturing a baseball batting training device as described above and best shown in FIGS. 5–9, comprises the steps of: forming a mold having a cup shaped mold cavity, the mold having a threaded bore at a bottom side of the mold in communication with the mold cavity; threading a bolt through the mold in threaded engagement with the threaded bore; threading an internally threaded nut on the bolt so that the nut is within the cup shaped mold cavity in a spaced apart relationship with a mold cavity bottom of the cup shaped mold cavity; forming a pair of annular members by clamping opposite ends of a pair of wires with clamps; inserting the clamps of the annular members into the cup shaped mold cavity so that a clamp of each annular member is on either side of the bolt; and pouring a molten lead in the cup shaped mold cavity to envelope the clamps and an outside surface of the nut to create a molded product.

Once the molten lead has cooled to form the molded product, which makes up the weight 15, the method comprises the additional steps of removing the molded product from the mold, cleaning and filing the molded product so that there are not any rough surfaces or edges, painting the molded product with a paint of suitable type, such as a plastic or rubberized paint; removing the die bolt from the molded product; threading a jam nut onto a bolt; and threading the bolt into the molded product.

A method of manufacturing the baseball batting training device shown in FIGS. 10–27, comprises the steps of: forming a circular weight from any type of conventional forming method, such as with a stamping machine; drilling and tapping a threaded bore through the weight; drilling a first aperture extending through the weight perpendicular to the threaded bore on one side of the weight; drilling a second aperture extending through the weight parallel to the first aperture on another side of the weight; threading a jam nut onto a bolt; threading the bolt through the threaded bore of the weight; and attaching a pair of annular members to the weight so that the annular members are attached on either sides of the bolt.

The step of attaching a pair of annular members to the weight so that the annular members are attached on either sides of the bolt is different for the embodiment shown in FIGS. 15–19 than from the embodiment shown in FIGS. 20–23.

Referring to the method of manufacturing the embodiment shown in FIGS. 15–19, the step of attaching comprises the steps of: attaching the first end of one annular member to one end of the first aperture and attaching the second end of that annular member to another end of the first aperture; and attaching the first end of another annular member to one end of the second aperture and attaching the second end of that annular member to another end of the second aperture. These steps of attaching preferably include the step of spot welding. However, other forms of securement, such with adhesive or liquid metal, could also be used.

Referring to the method of manufacturing the embodiment shown in FIGS. 20–23, the step of attaching comprises the steps of. inserting the first end and second end of one annular member in lapped relationship within the first aperture; inserting the first end and second end of the other annular member in lapped relationship within the second aperture; and securing the lapped first end and second end of the annular members within the corresponding first aperture and second aperture.

Preferably, the step of securing the lapped first end and second end of the annular members within the corresponding first aperture and second aperture, comprises the steps of: drilling and tapping a first threaded screw bore into the weight perpendicular to and in communication with the first aperture; drilling and tapping a second threaded screw bore perpendicular to and in communication with the second aperture; inserting a first set screw in threaded engagement within the first threaded screw bore and in pressing engagement with the first end and the second end of one annular member; and inserting a second set screw in threaded engagement within the second threaded screw bore and in pressing engagement with the first end and the second end of the other annular member. The weight may then be painted with a paint of suitable type.

Under the current rules of baseball it is forbidden to use a baseball batting device of the type described during a regulation game. If the device were used in a game, for example, there might be some tendency for the wire rings to become partially disengaged or distorted in position and hence usage of this device is not intended for game conditions. It is intended to be a device used by a player during a practice session with his or her instructor. Thus, this device can be used during training sessions by a player to aid in improving his or her baseball batting swing, and ultimately aimed towards the end of increasing the velocity of the bat head at the point of impact with the ball. In a typical training procedure, the instructor will observe the player making practice swings with the training device at the end of the bat, to attempt to instruct the player in proper techniques in the execution of the batting swing. In the course of this training procedure, the instructor may elect to have a ball put on a practice tee, or throw the ball vertically upward and have the player strike the ball with the training device on the bat.

In operation, the top hand on the baseball bat is the power hand. When you swing with a conventional weight located at the sweet spot of the bat, you start your swing and lead the bat with your hands. As you swing through, the inertia starts to push the bat away from your hands and thus your top hand is not transferring much power or snap to the bat when it impacts a ball. By using the baseball batting training device at the knob of the bat, you swing the bat and you lead with your hands but the bat does not create the usual inertial force away from your hands. Now, your top hand has to push the head of the bat to transfer power or snap to the bat to make it impact a ball. By training with this device you build up your top hand and arm muscles. Thus, after having trained with a baseball batting training device, when you swing a bat without the baseball batting training device attached to your bat you will swing the bat with more bat head speed. Finally, this device can be used on either wooden bats or aluminum bats, as desired.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. In combination, a baseball bat with a knob at one end, and a baseball batting training device comprising a weight sized for positioning in co-axial assembly with the knob of the baseball bat, the weight having an internally threaded nut secured in fixed assembly with said weight, a bolt bore extended through the weight co-axially aligned with a threaded bore defined by the internally threaded nut, a bolt with external threads threadingly engaged through said threaded bore of the internally threaded nut, a jam nut threadingly engaged to the bolt, and a pair of annular members attached in integral assembly with said weight, the annular members being extended away from the weight in a crossed pattern and being positioned in engagement with axially facing remote surface areas of said knob of the baseball bat, the bolt exerting a pulling force against the pair of annular members engaged against the axially facing remote surface areas of said knob to hold the baseball batting training device in fixed assembly with the knob of said baseball bat.

2. The combination of claim 1, wherein the bolt has an enlarged head that can be manually turned to cause the external threads to move axially of the threaded bore of the nut for tightening the engagement of a lead end of the bolt against the knob, the bolt being rotatable in a reverse direction to release the tension between the bolt and the knob end of the bat to enable the annular members to be progressively relieved of tension forces for allowing the crossed annular members to be detached from engagement with the knob of the baseball bat, the jam nut having an outer ring portion that can be manually turned to move the jam nut axially along the bolt for secured engagement with a top side of the weight.

3. The combination of claim 1, wherein the annular members are comprised of woven steel wire rings, and clamp means attaching ends of the rings of woven steel wire to secure the ends of each of the rings in a closed position, the clamps being embedded in the weight to fixedly connect the annular members with the weight.

4. In combination, a baseball bat with a knob at one end, and a baseball batting training device comprising, a weight sized for positioning in co-axial assembly with the knob of the baseball bat, the weight having a threaded bore, a bolt with external threads is threadingly engaged through said threaded bore, a jam nut threadingly engaged to the bolt, a pair of annular members, means for attaching the annular members to the weight so that the annular members are extended away from the weight in a crossed pattern and are positioned in engagement with axially facing remote surface areas of said knob of the baseball bat, the bolt exerting a pulling force against the pair of annular members engaged against the axially facing remote surface areas of the knob to hold the baseball batting training device in fixed assembly with the knob of said baseball bat.

5. The combination of claim 4, wherein the bolt has an enlarged head that can be manually turned to cause the external threads to move axially of the threaded bore of the nut for tightening the engagement of a lead end of the bolt against the knob, the bolt being rotatable in a reverse direction to release the tension between the bolt and the knob end of the bat to enable the annular members to be progressively relieved of tension forces for allowing the crossed annular members to be detached from engagement with the knob of the baseball bat, the jam nut having an outer ring portion that can be manually turned to move the jam nut axially along the bolt for secured engagement with a top side of the weight.

6. The combination of claim 4, wherein the means for attaching the annular members to the weight includes the weight having a first aperture and a second aperture, the first aperture extending through the weight perpendicular to the threaded bore on one side of the weight, the second aperture extending through the weight parallel to the first aperture on another side of the weight, the annular members having a first end and a second end, means for attaching the first end of one annular member to one end of the first aperture and the second end of that annular member to another end of the first aperture, and means for attaching the first end of the other annular member to one end of the second aperture and the second end of the other annular member to another end of the second aperture.

7. The combination of claim 4, wherein the means for attaching the annular members to the weight includes the weight having a first aperture and a second aperture, the first aperture extending through the weight perpendicular to the threaded bore on one side of the weight, the second aperture extending through the weight parallel to the first aperture on another side of the weight, the annular members having a first end and a second end, the first end and second end of one annular member being in lapped relationship within the first aperture, the first end and second end of the other annular member being in lapped relationship within the second aperture, and means for the securing the lapped first end and second end of the annular members within the corresponding first aperture and second aperture.

8. The combination of claim 7, wherein the means for the securing the lapped first end and second end of the annular members within the corresponding first aperture and second aperture includes the weight having a first threaded screw bore perpendicular to and in communication with the first aperture and a second threaded screw bore perpendicular to and in communication with the second aperture, a first set screw in threaded engagement within the first threaded screw bore and in pressing engagement with the first end and the second end of one annular member, and a second set screw in threaded engagement within the second threaded screw bore and in pressing engagement with the first end and the second end of the other annular member.

9. A baseball batting training device which includes a weight sized for positioning in co-axial assembly with a knob of a baseball bat, the weight having a threaded bore, a bolt with external threads is threadingly engaged through said threaded bore, a jam nut threadingly engaged to the bolt, a pair of annular members, means for attaching the annular members to the weight so that the annular members are extended away from the weight in a crossed pattern and are adopted to be positioned in engagement with axially facing remote surface areas of said knob of the baseball bat, the bolt adapted to exert a pulling force against the pair of annular members engaged against the axially facing remote surface areas of the knob to hold the baseball batting training device in fixed assembly with the knob of said baseball bat.

10. The device of claim 9, wherein the means for attaching the annular members to the weight includes the weight having a first aperture and a second aperture, the first aperture extending through the weight perpendicular to the threaded bore on one side of the weight, the second aperture extending through the weight parallel to the first aperture on another side of the weight, the annular members having a first end and a second end, means for attaching the first end of one annular member to one end of the first aperture and the second end of that annular member to another end of the first aperture, and means for attaching the first end of the other annular member to one end of the second aperture and the second end of the other annular member to another end of the second aperture.

11. The device of claim 9, wherein the means for attaching the annular members to the weight includes the weight having a first aperture and a second aperture, the first aperture extending through the weight perpendicular to the threaded bore on one side of the weight, the second aperture extending through the weight parallel to the first aperture on another side of the weight, the annular members having a first end and a second end, the first end and second end of one annular member being in lapped relationship within the first aperture, the first end and second end of the other annular member being in lapped relationship within the second aperture, and means for the securing the lapped first end and second end of the annular members within the corresponding first aperture and second aperture.

12. A method of manufacturing a baseball batting training device for use with a baseball bat having a knob at one end, comprising the steps of:

(a) forming a circular weight;

(b) drilling and tapping a threaded bore through the weight;

(c) drilling a first aperture extending through the weight perpendicular to the threaded bore on one side of the weight;

(d) drilling a second aperture extending through the weight parallel to the first aperture on another side of the weight;

(e) threading a jam nut onto a bolt;

(f) threading the bolt through the threaded bore of the weight; and (g) attaching a pair of annular members to the weight so that the annular members are attached on either sides of the bolt.

13. The method of claim 12, wherein the step of attaching a pair of annular members to the weight so that the annular members are attached on either sides of the bolt, include each annular member having a first end and a second end, and further comprise the steps of:

(a) attaching the first end of one annular member to one end of the first aperture and attaching the second end of that annular member to another end of the first aperture; and (b) attaching the first end of the other annular member to one end of the second aperture and attaching the second end of the other annular member to another end of the second aperture.

14. The method of claim 12, wherein the step of attaching a pair of annular members to the weight so that the annular members are attached on either sides of the bolt, include each annular member having a first end and a second end, and further comprise the steps of:

(a) inserting the first end and second end of one annular member in lapped relationship within the first aperture;

(b) inserting the first end and second end of the other annular member in lapped relationship within the second aperture; and (c) securing the lapped first end and second end of the annular members within the corresponding first aperture and second aperture.

15. The method of claim 14, wherein the step of securing the lapped first end and second end of the annular members within the corresponding first aperture and second aperture, comprises the steps of:

(a) drilling and tapping a first threaded screw bore into the weight perpendicular to and in communication with the first aperture;

(b) drilling and tapping a second threaded screw bore perpendicular to and in communication with the second aperture;

(c) inserting a first set screw in threaded engagement within the first threaded screw bore and in pressing engagement with the first end and the second end of one annular member; and (d) inserting a second set screw in threaded engagement within the second threaded screw bore and in pressing engagement with the first end and the second end of the other annular member.

16. The method of claim 12, further comprising the step of painting the weight with a paint of suitable type.

* * * * *